United States Patent [19]

Gasparics

[11] Patent Number: 4,617,944

[45] Date of Patent: Oct. 21, 1986

[54] SAFETY CIGARETTE HOLDER IN A STACKABLE ASHTRAY

[76] Inventor: Istvan Gasparics, 622 W. Pender St., Vancouver, British Columbia, Canada, V6B 1V8

[21] Appl. No.: 633,491

[22] Filed: Jul. 23, 1984

[51] Int. Cl.[4] ..... A24F 19/14

[52] U.S. Cl. ..... 131/235.1; 131/240.1; 131/241; 131/256

[58] Field of Search ..... 131/235 R, 231, 240.1, 131/241, 225, 260, 235.1, 256, 257, 237

[56] References Cited

U.S. PATENT DOCUMENTS

| | | | |
|---|---|---|---|
| 1,894,128 | 1/1933 | Schult | 131/260 |
| 2,099,125 | 11/1937 | Langslow | 131/260 |
| 2,448,105 | 8/1948 | Lynch | 131/240.1 |
| 2,498,330 | 2/1950 | Block | 131/256 |
| 2,526,488 | 10/1950 | Laichee | 131/240.1 |
| 2,800,909 | 7/1957 | Shlatterer | 131/235.1 |
| 3,841,339 | 10/1974 | Fox et al. | 131/235 R |

*Primary Examiner*—V. Millin
*Assistant Examiner*—H. Macey
*Attorney, Agent, or Firm*—Barrigar & Oyen

[57] ABSTRACT

A cigarette holder for use on an ashtray consists of two cylindrical rings each mounted on a deformable elastic supporting member. The rings are so spaced as to be displaced by and grip a cigarette placed between them and thereby prevent the cigarette from falling off the ashtray. The use of the cigarette holder in a stackable ashtray configuration in which the upper ashtray unit is screwed into the lower ashtray unit is also shown.

3 Claims, 11 Drawing Figures

SAFETY CIGARETTE HOLDER IN A STACKABLE ASHTRAY

BACKGROUND OF THE INVENTION

1. Field of the Invention

The invention relates to the field of safety ashtrays. In particular, it relates to a safety cigarette holder to prevent lit cigarettes from falling out of the ashtray. The invention also relates to a stackable ashtray.

2. Brief Description of the Prior Art

A common hazard with conventional ashtrays which is the source of many house fires is the defect in common ashtray design whereby a lit cigarette is balanced on the circumference of the ashtray until the cigarette burns down to a certain point at which the unlit end of the cigarette extending outside the ashtray outweighs the lit end of the cigarette inside the ashtray. At this point the lit cigarette falls onto the floor or furniture. Similarly, the cigarette may simply fall out of the ashtray when the ashtray is jarred. The cigarette-receiving groves or channels in the ashtray may be so configured as to wedge the cigarette in place, however this deforms the cigarette which is undesirable for the smoker. Locating the cigarette holder in the interior of the ashtray may solve this problem, but results in an ashtray which is overly large and bulky and generally less convenient to use.

It is also known to be desirable to utilize stackable ashtrays which permit a number of ashtrays to be stored or carried as a unit. Such a stackable ashtray, which includes a centrally located cigarette holder and snuffing device for safety purposes is disclosed in U.S. Pat. No. 3,841,334 entitled "Stackable Safety Ashtray", issued Oct. 15, 1974 to J. C. Fox and Elbert A. Delay. Such stacked ashtrays also permit a rapid replacement of a full ashtray with a clean ashtray without actually emptying the ashtray, and cause the smouldering butts in a full ashtray to be extinguished by stacking an empty mating ashtray on top of the full ashtray. In the Fox ashtray however, the stacked ashtrays are not secured one to the other and will separate if up-ended, causing a considerable mess. The lack of securing means also makes the stacking of more than a few ashtrays hazardous.

SUMMARY OF THE INVENTION

The present invention provides a safety cigarette holding device which holds the cigarette securely without deforming it and which aids in extinguishing the cigarette when the lit portion contact the holder. The holder comprises two non-flammable, heat-resistant holding elements which are resiliently mounted on either side of a channel for holding the cigarette and are so spaced as to bear against the sides of the cigarette when the cigarette is placed in the channel.

The invention further provides a system for stacking ashtrays wherein the bottom of each modular ashtray unit is provided with screw threads for threadedly engaging complementary threads on the upper edge of each unit. Each ashtray may be provided with the safety cigarette holding mechanism of the invention, in which case the underside of each ashtray is shaped to receive the mechanism from the lower ashtray when the ashtrays are nested. Each ashtray may comprise a separate ashtray plate section for containing the ashes which is removable from the outer ashtray shell. The ashtray shell unit may consist of three separate elements which are themselves threadedly engaged and are secured by means of a pin.

BRIEF DESCRIPTION OF THE DRAWINGS

In drawings which illustrate an embodiment of the invention.

DETAILED DESCRIPTION OF A PREFERRED EMBODIMENT

Figure 1:
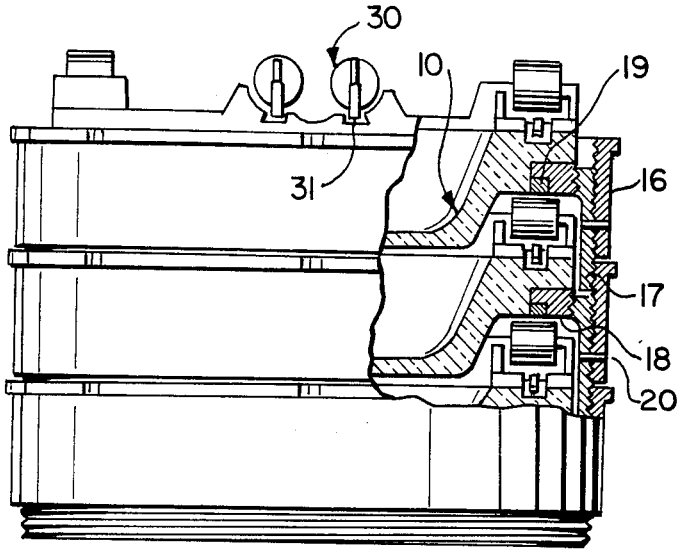
FIG. 1 is a side view of an embodiment of the invention in which three ashtray units are stacked, partly cut away to show the units in cross-section.
Figure 5:
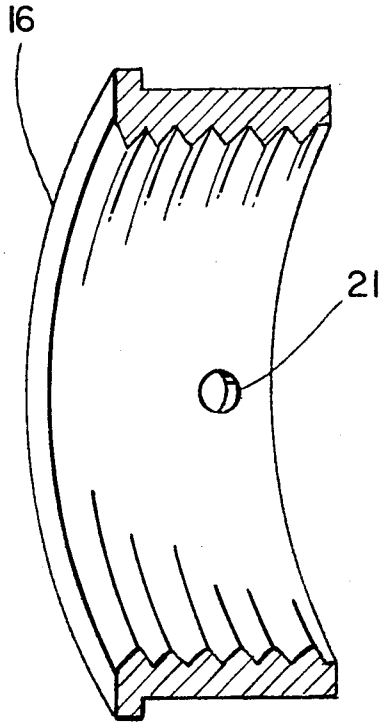
FIGS. 3, 4 and 5 are cut-away sections of the component rings for an ashtray unit as shown in FIG. 1.
Figure 4:
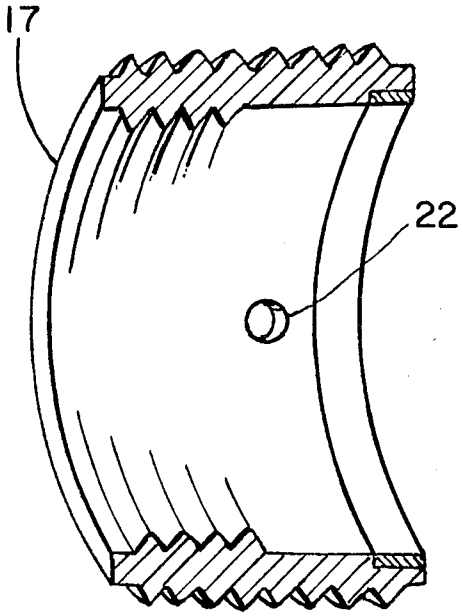
Figure 3:
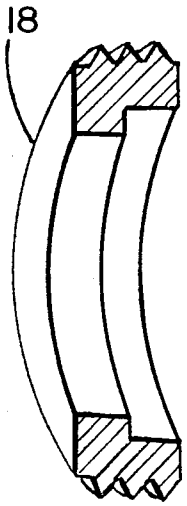

Referring to FIG. 1, three ashtray units are shown in stacked configuration. Each unit consists of three threaded annular ring elements 16, 17 and 18, which are shown in FIGS. 3, 4 and 5 respectively, and ashtray plate 10. The three annular ring elements 16, 17 and 18 form the supporting shell for ashtray plate 10. The external threads of ring 18 are screwed into the internal threads ring 17 so that the upper surface of ring 18 is slightly above the upper surface of ring 17. The external threads of ring 17 are screwed into the internal threads of ring 16 so that holes 21 and 22 are aligned. A pin 20 may then be inserted with a tight fit into holes 21 and 22 to prevent further relative rotation of rings 16 and 17. Rings 16, 17 and 18 may be constructed of any suitable material such as molded plastic.

Figure 2:
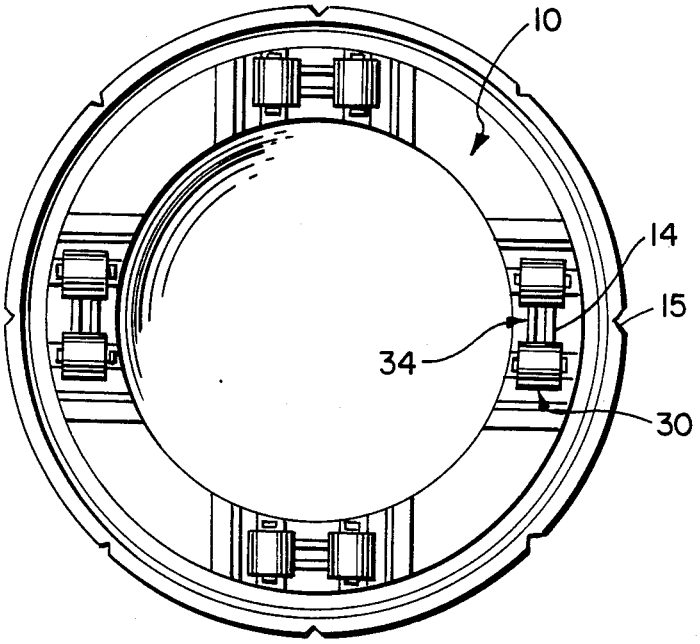
FIG. 2 is a top view of the ashtrays shown in FIG. 1.
Figure 6:
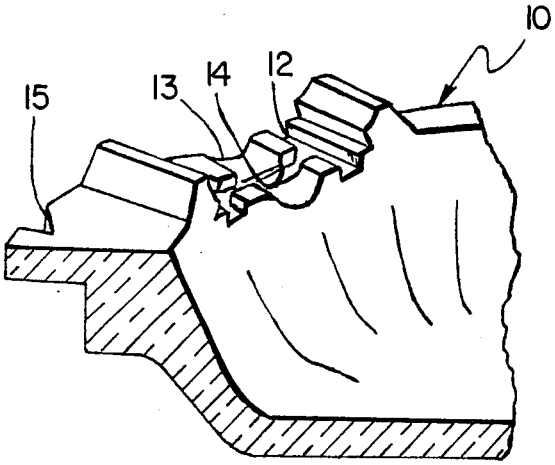
FIG. 6 is a cut-away section of the ashtray plate for an ashtray unit shown in FIG. 1.

Central ashtray plate 10 as shown in FIGS. 1, 2 and 6 is constructed of a suitably heat-resistant and washable material such as glass or molded plastic. Plate 10 is provided with a central circular depression for holding the ashes and cigarette butts and a raised exterior circumference on which are mounted the cigarette holders 30. The underside of the exterior circumference of plate 10 forms a shoulder which rests on the upper surface of ring 18. Plate 10 is held securely in place by virtue of a tight friction fit between an exterior circumferential surface of the plate and a circular rubber ring 19 which is located in a recess in ring 18 as shown in FIG. 1. Plates 10 can thus be removed for cleaning either separately or by unscrewing the combined unit of plate 10 and ring 18.

The arrangement of elements 16 and 17 allows one unit to be threaded onto a second unit by threading the lower portion of the external threads of ring 17 of the upper unit into the upper portion of the internal threads of ring 16 of the lower unit. Three or more units may be joined in this manner, with the topmost ashtray plate receiving the fresh cigarette butts. When the top unit is filled, it may be removed to the lowermost portion where, once screwed into place, any smouldering butts will be extinguished due to lack of oxygen. The emptying of any unit can thus be delayed until all units in the stack have been filled. Grooves 15 are provided on the circumference of ring 16 to facilitate the unscrewing of an ashtray unit. The undersides of plates 10 are also configured so as to receive the cigarette holders 30 from the lower ashtray unit when the ashtray units are stacked. The lower surface of ring 17 in each unit may be provided with a protective rubber surface to prevent scratching of the furniture on which the stack of ashtrays sits.

Figure 9:
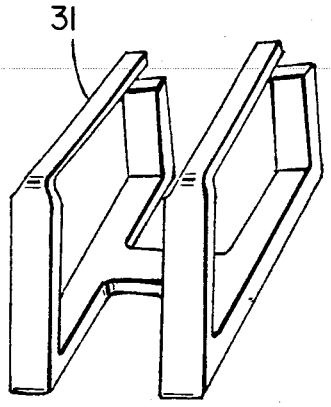
FIG. 9 is a perspective view of the mounting frame for the cigarette holder shown in FIG. 1.
Figure 10:
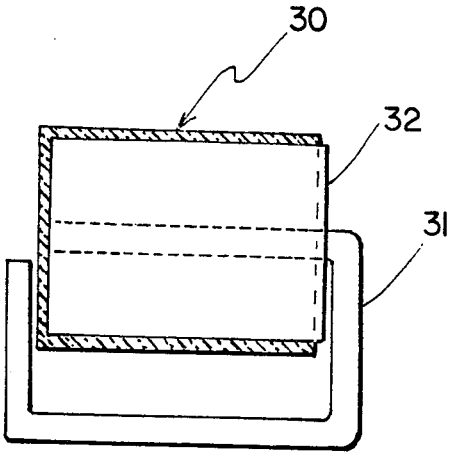
FIG. 10 is a cross-sectional view of the cigarette holder shown in FIG. 1.
Figure 11:
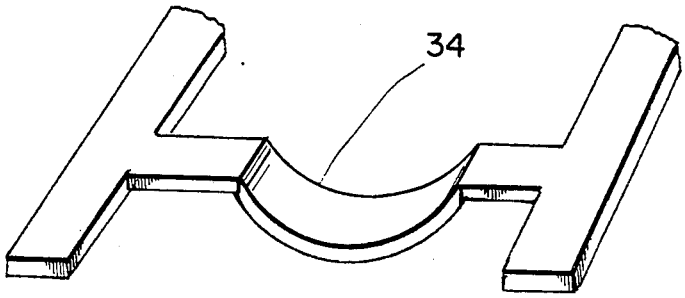
FIG. 11 is a perspective view of the mounting plate for the cigarette holder shown in FIG. 1.

The safety cigarette holder is shown in FIGS. 1, 2 and 7 through 11. Each holder consists of two hollow cylinders 30, which are preferably of metal and may have one closed end. The cylinders may be of other fire and heat resistant material such as glass, and may be other suitable shapes. Each cylinder is mounted in a frame 31. As seen in FIG. 9 and 10, frame 31 consists of two vertical rectangles which are joined by a cross-piece. The upper horizontal side of the rectangles is separated at one end from the horizontal side of the rectangle to allow for installation of the cylinder.

Figure 7:
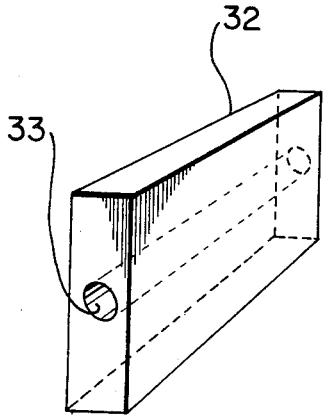
FIG. 7 is a perspective view of the resilient rubber element for the cigarette holder shown in FIG. 1, showing the central hole in dotted outline.
Figure 8:
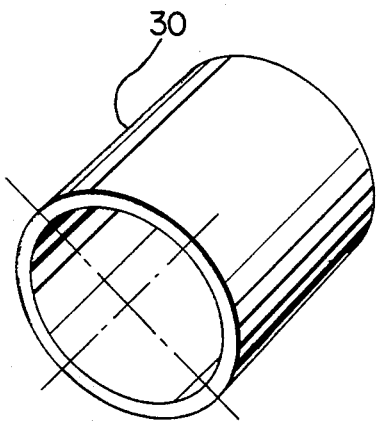
FIG. 8 is a perspective view of the cylindrical ring for one of the cigarette holders shown in FIG. 1.

The circumference of the ashtray plate 10 is provided at each cigarette-holding location with a channel 13 for receiving a cigarette. As shown in FIG. 6, there are slots 12 on either side of channel 13 and a connecting slot 14 to receive the frame 31. The cylindrical rings 30 are mounted on frame 31 by means of a slab 32 of an elastic deformable material such as rubber, as shown in FIG. 7. The slab 32 is provided with a central hole 33 by means of which it is mounted on one of the upper horizontal prongs of frame 31. The width of the slab is equal to the diameter of ring 30 so that the ring 30 may in turn be mounted on rubber slab 32 with the edges of the slab contacting the inside surface of the ring along its length. The rubber slab or diaphragm thereby lies along the diameter of cylinder 30 in the installed position shown in FIG. 10.

With no cigarette in place, as shown in FIG. 1, the distance between the outside edges of the two cylindrical rings 30 is designed to be slightly less than the diameter of a cigarette. The degree to which this distance is less than the diameter of a cigarette will depend on the stiffness of rubber slabs 32. When a cigarette is forced into position between the two cylinders, the two rubber slabs deform, their upper and lower edges being forced outwardly with the cylinder. This allows the cigarette to rest in channel 13, but the elasticity of the rubber elements 32 causes the inside edges of the cylinders to bear against the cigarette and hold it firmly in place, without significantly deforming the cigarette. The cigarette is thus prevented from falling out of the ashtray when the ashtray is tipped or jarred, or when the cigarette burns down and becomes unbalanced.

The configuration of the safety holder also encourages the cigarette to extinguish when the cigarette burns down to the edge of the holder. This is because of the pressure applied to the cigarette by the two cylindrical rings, as well as the contact of the cigarette against channel 13. The safety holder may be installed on any standard ashtray, car ashtray, or wherever a cigarette is to be held.

As will be apparent to persons skilled in the art, various modifications and adaptations of the structure above described are possible without departing from the spirit of the invention, the scope of which is defined in the appended claims.

I claim:

1. The combination of an ashtray and a device for holding a cigarette on an ashtray, said device comprising two opposing, parallel, cylindrical cigarette-securing elements, the opposed surfaces of said cigarette-securing elements being spaced apart a distance less than the diameter of a cigarette, each said cigarette-securing element comprising:

(a) a supporting frame having a vertical member extending upwardly from and secured on said ashtray and a horizontal member extending from said vertical member;

(b) each said cylindrical element being a hollow cylinder of non-flammable material; and (c) a means for supporting said cylinder substantially concentrically about said horizontal member comprising a piece of elastic material mounted within said hollow cylinder and mounted on said horizontal member, wherein at least two portions of said piece of elastic material bear against the interior surface of said hollow cylinder;

whereby when a cigarette is aligned horizontally and parallel to said cigarette-securing elements and is pressed between said hollow cylinders, said hollow cylinders bear against the sides of said cigarette and are displaced outwardly, deforming said elastic pieces, until the widest part of said cigarette passes below the narrowest point between said hollow cylinders, and said elastic pieces cause said hollow cylinders to return inwardly and bear downwardly on said cigarette, thereby securing said cigarette on said ashtray.

2. The combination of claim 1 wherein said hollow cylinders are composed of a metal.

3. The combination of claim 1 further comprising a cigarette-receiving groove in the surface of said ashtray parallel to and centered below said two cigarette-securing elements to receive said cigarette.

* * * * *